US010887959B2

(12) United States Patent
Guth et al.

(10) Patent No.: US 10,887,959 B2
(45) Date of Patent: Jan. 5, 2021

(54) CIRCUIT ARRANGEMENT FOR GENERATING A REFERENCE VOLTAGE FOR THE POWER SUPPLY OF AN LED ARRANGEMENT

(71) Applicant: ZKW Group GmbH, Wieselburg (AT)

(72) Inventors: Christian Guth, Mariasdorf (AT); Harald Graf, Würflach (AT)

(73) Assignee: ZKW Group GmbH, Wieselburg (AT)

( * ) Notice: Subject to any disclaimer, the term of this patent is extended or adjusted under 35 U.S.C. 154(b) by 0 days.

(21) Appl. No.: 16/756,524

(22) PCT Filed: Sep. 28, 2018

(86) PCT No.: PCT/EP2018/076416
§ 371 (c)(1),
(2) Date: Apr. 16, 2020

(87) PCT Pub. No.: WO2019/076608
PCT Pub. Date: Apr. 25, 2019

(65) Prior Publication Data

US 2020/0359473 A1 Nov. 12, 2020

(30) Foreign Application Priority Data

Oct. 19, 2017 (EP) ..... 17197293

(51) Int. Cl.
*H05B 39/00* (2006.01)
*H05B 45/14* (2020.01)
*H05B 45/18* (2020.01)

(52) U.S. Cl.
CPC ..... *H05B 45/14* (2020.01); *H05B 45/18* (2020.01)

(58) Field of Classification Search
CPC ..... H05B 45/14; H05B 45/18
See application file for complete search history.

(56) References Cited

U.S. PATENT DOCUMENTS

2007/0274138 A1 11/2007 Ogiwara et al.
2009/0201067 A1 8/2009 Haneda
(Continued)

OTHER PUBLICATIONS

Search Report for European Patent Application No. 17197293, dated Mar. 16, 2018 (1 page).
(Continued)

*Primary Examiner* — Minh D A
(74) *Attorney, Agent, or Firm* — Eversheds Sutherland (US) LLP

(57) ABSTRACT

A circuit arrangement (1) for generating a reference voltage ($U_{ref}$) for the power supply (2) of an LED arrangement (LED), wherein the power supply supplies a feed current ($I_S$) to the LED arrangement on the basis of an input voltage ($U_B$), which current is determined by the magnitude of the reference voltage, wherein the circuit arrangement comprises: a first voltage divider (R1/R2), located on a constant power supply voltage ($U_V$), a second voltage divider (R3/R4), located on the input voltage ($U_B$) of the power supply (2), and a third voltage divider (R5/R6) which consists of an ohmic resistor (R5) and a temperature-dependent resistor (R6) thermally coupled to the LED arrangement, a voltage proportional to the voltage on the centre connection of the second voltage divider (R3/R4) is supplied via a first diode (D1) to the centre connection of the first voltage divider (R1/R2), a voltage proportional to the voltage on the centre connection of the third voltage divider (R5/R6) is further supplied via a second diode (D2) to the centre connection of the first voltage divider (R1/R2), and the voltage on the centre connection of the first voltage divider (R1/R2) is supplied to the power supply (2) as a reference voltage ($U_{ref}$).

7 Claims, 3 Drawing Sheets

(56) References Cited

U.S. PATENT DOCUMENTS

| | | | | |
|---|---|---|---|---|
| 2014/0210361 | A1* | 7/2014 | Ferrier | H05B 45/395 315/186 |
| 2014/0218953 | A1 | 8/2014 | Ungru | |
| 2016/0044760 | A1* | 2/2016 | Robert | H05B 45/50 315/151 |
| 2017/0280523 | A1* | 9/2017 | Kathiresan | H02M 3/33561 |

OTHER PUBLICATIONS

International Search Report for PCT/EP2018/076416, dated Nov. 28, 2018 (2 pages).

* cited by examiner

CIRCUIT ARRANGEMENT FOR GENERATING A REFERENCE VOLTAGE FOR THE POWER SUPPLY OF AN LED ARRANGEMENT

The invention relates to a circuit arrangement for generating a reference voltage for the power supply of an LED arrangement, wherein the power supply supplies a feed current for the LED arrangement on the basis of an input voltage, which current is determined by the magnitude of the reference voltage.

Circuit arrangements of this type are known in a large number and are used in power supplies for LED arrangements, mostly series circuits of LEDs. In particular in the field of automotive lighting technology, a high constancy of the luminance of LED arrangements is desired or required by regulations, wherein primarily the dependence of the current flowing through the arrangement on fluctuations of the input voltage, usually the voltage of the automotive battery, and of the temperature of the LED arrangement are to be taken into account and, moreover, excessive LED temperatures are to be avoided.

In order to solve these problems, different circuit arrangements have become known. For example, JP 2007280458 A describes a circuit arrangement for generating a reference voltage which is dependent on an input voltage and the temperature. A first circuit generates a current dependent on the input voltage which is added to a temperature-dependent current which is supplied by a second circuit. The sum of these currents flows through a resistor of a third circuit which supplies the desired output voltage through the voltage dropping across the resistor.

The cost of circuit arrangements known from prior art is significant and is perceived as too high for many applications. It is therefore an object of the invention to create a circuit arrangement which can be implemented in a cost-effective manner.

This object is achieved with a circuit arrangement of the type mentioned above, comprising, according to the invention: a first voltage divider which consists of two ohmic resistors and which is connected to a constant power supply voltage, a second voltage divider which consists of two ohmic resistors and which is connected to the input voltage of the power supply, and a third voltage divider which consists of an ohmic resistor and a temperature-dependent resistor and which is connected to the constant power supply voltage, wherein the temperature-dependent resistor is thermally coupled to the LED arrangement, a voltage proportional to the voltage at the centre terminal of the second voltage divider is supplied to the centre terminal of the first voltage divider via a first diode, a voltage proportional to the voltage at the centre terminal of the third voltage divider is further supplied to the centre terminal of the first voltage divider via a second diode, and the voltage at the centre terminal of the first voltage divider is supplied to the power supply as a reference voltage.

The invention provides a simple and cost-effective possibility of generating a temperature-dependent and input-voltage-dependent reference voltage.

With regard to a particularly simple construction, it is advantageous if the centre terminal of the first voltage divider is connected to the centre terminal of the second voltage divider via a first diode and, furthermore, the centre terminal of the first voltage divider is connected to the centre terminal of the third voltage divider via a second diode.

In order to achieve a steeper derating, it can advantageously be provided that the voltage at the centre terminal of the second voltage divider and/or the third voltage divider is supplied to the centre terminal of the first voltage divider via an amplifier stage.

In this case, a simple and economical solution can be achieved if the amplifier stage comprises a transistor the base of which is connected to the centre terminal of the second voltage divider and/or to the centre terminal of the third voltage divider, wherein the collector connected to a collector resistance is connected to the centre terminal of the first voltage divider via the first and/or second diode.

Furthermore, it is useful if the power supply voltage of the circuit arrangement is also the power supply voltage of the power supply.

Furthermore, it is beneficial if the input voltage is supplied to the power supply via an interference suppression filter.

In addition, it can advantageously be provided that the power supply comprises a controlled current source to which with the reference voltage is supplied and which supplies the feed current controlled by said reference voltage.

The invention including its further advantages is explained in more detail below by means of exemplary embodiments which are illustrated in the drawing. In the figures.

Figure 1:
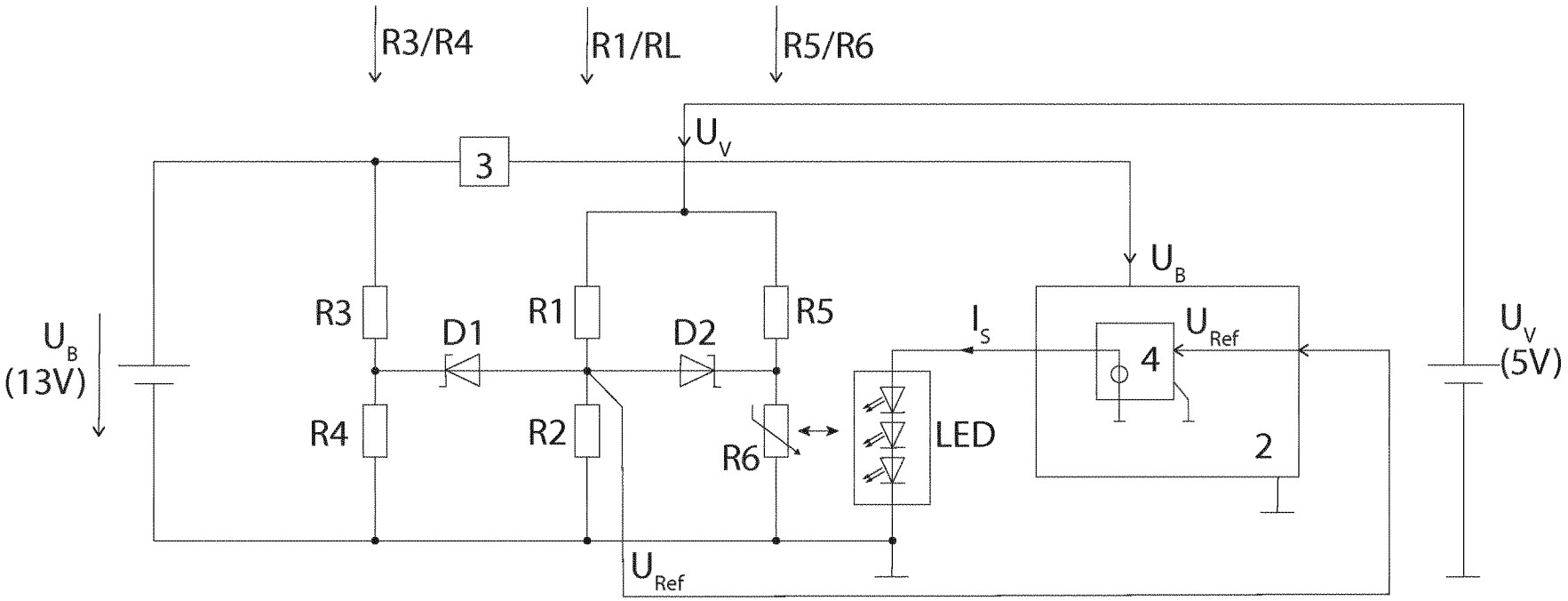
FIG. 1 shows a circuit diagram of a first embodiment of the invention.

Referring now to FIG. 1, a circuit arrangement 1 can be seen which in principle has three voltage dividers, namely a first voltage divider R1/R2 consisting of two ohmic resistors R1, R2, which is connected to a constant power supply voltage $U_V$, for example 5 Volt, a second voltage divider R3/R4 consisting of two ohmic resistors R3, R4, which is connected to an input voltage $U_B$, for example 13 V, of a car battery, a power supply 2 for an LED arrangement LED, and a third voltage divider R5/R6 which consists of an ohmic resistor R5 and a temperature-dependent resistor R6, in this example an NTC, and which is connected to the constant power supply voltage $U_V$.

The input voltage $U_B$ is advantageously supplied to the power supply 2 via an interference suppression filter 3. The power supply voltage $U_V$ can be supplied jointly to both the circuit arrangement 1 and the power supply 2, but separate power supply voltages are also possible.

Power supply 2 advantageously contains a controlled current source 4 to which a reference voltage $U_{ref}$ is supplied and which supplies a feed current $I_S$, which is controlled by this reference voltage $U_{ref}$, for the LED arrangement LED.

To generate this reference voltage $U_{ref}$, the circuit arrangement 1, which serves for derating the input voltage $U_B$ and the temperature of the load, in this case the LED arrangement LED, is now provided and is described in more detail below.

Firstly, it is essential that the temperature-dependent resistor R6 is thermally coupled to the LED arrangement LED, which means that it is arranged appropriately close to the LED arrangement LED or, for example, is located on a heat sink of the LED arrangement LED, which is not shown. The thermal coupling between the temperature-dependent resistor R6 and the LED arrangement LED is indicated in the drawing by a double-sided arrow.

The centre terminal of the first voltage divider R1/R2 is connected to the centre terminal of the second voltage divider R3/R4 via a first diode D1 and, furthermore, the centre terminal of the first voltage divider R1/R2 is connected to the centre terminal of the third voltage divider R5/R6 via a second diode D2. This means that the voltage at the centre terminal of the second voltage divider R3/R4 is supplied to the centre terminal of the first voltage divider R1/R2 via the first diode D1 and the voltage at the centre terminal of the third voltage divider R5/R6 is supplied to the centre terminal of the first voltage divider R1/R2 via the second diode D2.

The voltage at the centre terminal of the first voltage divider R1/R2 is supplied to the power supply 2 as reference voltage $U_{ref}$.

With regard to the function of the circuit arrangement according to the invention, the voltage divider R1/R2 as a "main voltage divider" fed by the power supply voltage $U_V$ supplies at its centre terminal the reference voltage $U_{Ref}$ for the power supply 2 during normal operation.

The third voltage divider R5/R6 for temperature derating, the centre terminal of which is connected to the centre terminal of the voltage divider R1/R2 via diode D2, is likewise fed by the power supply voltage $U_V$. If the resistor R6, in the example an NTC resistor, heats up due to heating of the load, namely the LED arrangement LED, fed by the power supply 2, its resistance decreases and, accordingly, the voltage at the centre of the voltage divider R5/R6 decreases as well. If this voltage value decreases below the value of the difference of the voltage at the centre terminal of the voltage divider R1/R2 minus the forward voltage at the diode D2, the reference voltage at the centre terminal of the voltage divider R1/R2 decreases as well and the desired derating of the reference voltage $U_{Ref}$ occurs when the load heats up.

Figure 4:
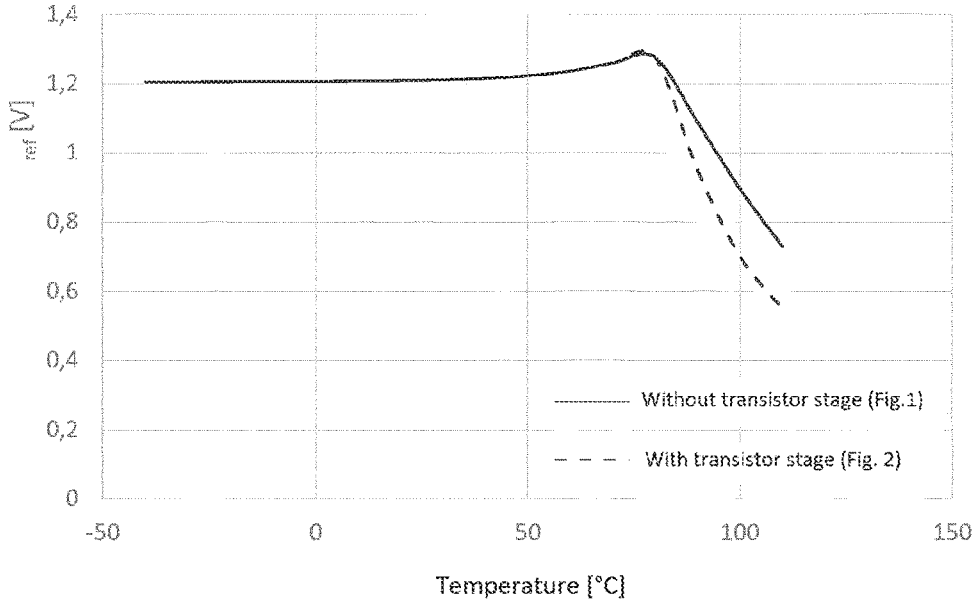
FIG. 4 shows a diagram to illustrate the derating of the temperature in the two exemplary embodiments.

An exemplary curve of the reference voltage as a function of temperature is shown in FIG. 4, where it can be seen that at a certain temperature and above, in this case approx. 50° C., the reference voltage initially rises slightly to approx. 80° C., but begins to fall steeply and approximately linearly upon reaching this temperature. In the mentioned FIG. 4, the solid line refers to the embodiment according to FIG. 1 and the dashed line refers to the embodiment according to FIG. 2 described further below.

FIG. 4 also shows that temperature derating is only activated above a certain temperature, which in practice can be in the range of 70° to 80° C. By appropriate dimensioning of the resistors R5 and R6 of the third voltage divider, it is possible to achieve, for example, that the diode D2 becomes conductive only at or above 70° C., for example, and thus active intervention in the first voltage divider R1/R2 takes place.

The derating of the input voltage also works according to the principle just described. The centre terminal of the second voltage divider R3/R4, fed by the input voltage $U_B$, is connected to the centre terminal of the first voltage divider R1/R2, the "main voltage divider", via the first diode D1. If the voltage value at the centre terminal of the second voltage divider R3/R4 decreases below the value of the difference of the voltage at the centre terminal of the voltage divider R1/R2 minus the forward voltage at the diode D1, the reference voltage $U_{Ref}$ at the centre terminal of the voltage divider R1/R2 decreases as well and the desired derating occurs with decreasing input voltage $U_B$.

Figure 2:
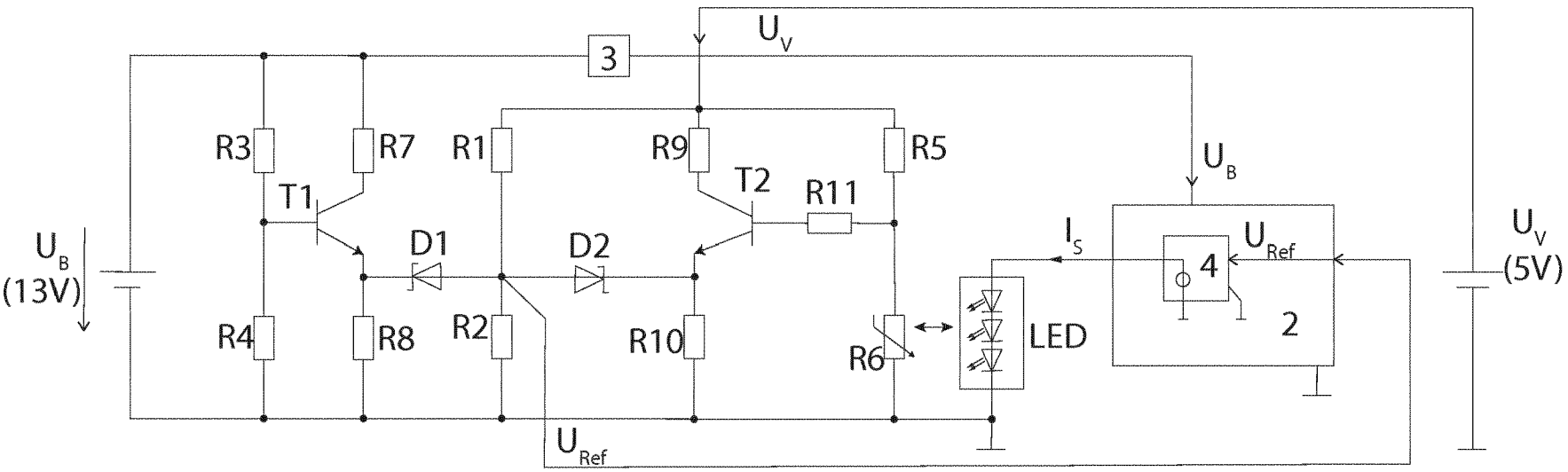
FIG. 2 shows a circuit diagram of a second embodiment of the invention.
Figure 3:
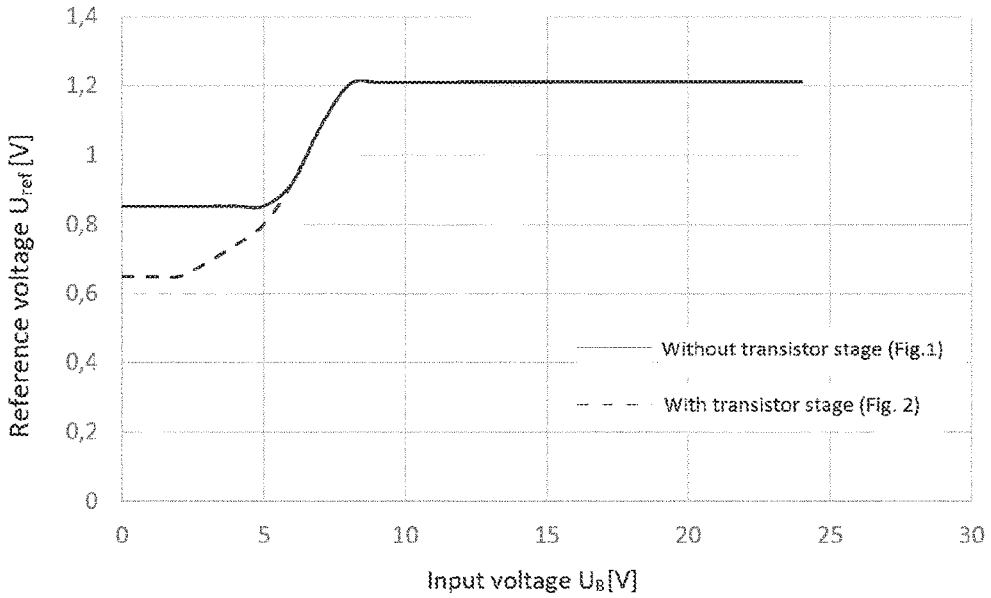
FIG. 3 shows a diagram to illustrate the derating of the input voltage in the two exemplary embodiments.

An exemplary curve of the reference voltage $U_{Ref}$ as a function of the input voltage $U_B$ is shown in FIG. 3, in which it can be seen that at a certain input voltage $U_B$ and above, in the present case approx. 8 Volt, the reference voltage remains constant, in the example shown at 1.2 Volt. If the input voltage $U_B$ decreases below the mentioned value, the reference voltage decreases approximately linearly up to a second value of the input voltage $U_B$, in the example approx. 5 Volt, and then remains at this value if the input voltage $U_B$ decreases further. In FIG. 3 too, the solid line refers to the embodiment according to FIG. 1 and the dashed line refers to the embodiment according to FIG. 2 described further below.

As in the case of the temperature derating, it applies to the voltage derating that depending on the requirements, the second voltage divider R3/R4 will be dimensioned such that only after the input voltage decreases below a certain critical value, approx. 8 volts in the example of FIG. 3, lowering of the reference voltage takes place, i.e. the diode D1 becomes conductive and active intervention in the first voltage divider R1/R2 takes place.

On the basis of the embodiment shown in FIG. 2 it is apparent that coupling the centre point voltages of the second and third voltage dividers R3/R4 and R5/R6 to the centre terminal of the first voltage divider R1/R2 can also be carried out via an amplifier stage to increase the slope of the control. Generally speaking, a voltage proportional to the voltage at the centre terminal of the second voltage divider R3/R4 can be supplied to the centre terminal of the first voltage divider R1/R2 via the first diode D1 and a voltage proportional to the voltage at the centre terminal of the third voltage divider R5/R6 can be supplied to the centre terminal of the first voltage divider R1/R2 via a second diode D2.

In FIG. 2 the mentioned amplifier stages are transistor amplifiers, although it should be noted that an amplifier stage does not necessarily have to be associated with both the second and the third voltage divider, but it is also possible to provide an amplifier stage only between the first voltage divider and the second or third voltage divider.

According to FIG. 2, the amplifier stages each comprise a transistor T1, T2, wherein the base of the transistor T1 is connected to the centre terminal of the second voltage divider R3/R4 and the base of the second transistor is connected to the centre terminal of the third voltage divider R5/R6. In this case, the collector of the first transistor T1, which collector is connected to a collector resistor R8, is connected to the centre terminal of the first voltage divider R1/R2 via the first diode D1. Analogously, the collector of the second transistor T2, which collector is connected to a collector resistor R10, is connected to the centre terminal of the first voltage divider R1/R2 via the second diode D2.

In the example shown, the transistors T1 and T2 are NPN-transistors, wherein the second voltage divider R3/R4 represents the base voltage divider of the first transistor and the third voltage divider R5/R6 represents the base voltage divider of the second transistor T2. Here, the base of the second transistor T2 is connected to the centre terminal of the third voltage divider R5/R6 via a resistor R11.

Referring again to FIGS. 3 and 4, the dependencies of the reference voltage $U_{Ref}$ on the input voltage (FIG. 3) and the temperature (FIG. 4) of the LED arrangement are shown therein in dashed lines. In FIG. 3 it is shown that with decreasing input voltage, the reference voltage $U_{Ref}$ in the circuit according to FIG. 2 drops even further than in the circuit according to FIG. 1, namely to a value of approx. 650 mV, and in FIG. 4 it can be seen that as a function of the increasing temperature, the reference voltage $U_{Ref}$ in the circuit according to FIG. 2 drops more steeply than in the circuit according to FIG. 1.

It is worth mentioning that the temperature sensor resistor R6 can also have a positive temperature dependency, thus can be designed as a PCT resistor. In this case, R5 and R6 must be interchanged in the circuit shown.

In general, it can be said that there are still other possibilities available to those skilled in the art in order to implement the circuit according to the invention, wherein in the arrangement according to FIG. 2, for example, other types of transistors or, if required, other amplifier stages, such as integrated circuits, can be used.

The invention claimed is:

1. A circuit arrangement (1) for generating a reference voltage ($U_{ref}$) for the power supply (2) of an LED arrangement (LED), wherein the power supply is configured to supply a feed current ($I_S$) to the LED arrangement on the basis of an input voltage ($U_B$), which current is determined by the magnitude of the reference voltage, the circuit arrangement comprising:

a first voltage divider (R1/R2) consisting of two ohmic resistors (R1, R2), which is connected to a constant power supply voltage ($U_V$), a second voltage divider (R3/R4) consisting of two ohmic resistors (R3, R4), which is connected to the input voltage ($U_B$) of the power supply (2), and a third voltage divider (R5/R6) which consists of an ohmic resistor (R5) and a temperature-dependent resistor (R6) and which is connected to the constant power supply voltage ($U_V$), wherein:

the temperature-dependent resistor is thermally coupled to the LED arrangement, a voltage proportional to the voltage at the centre terminal of the second voltage divider (R3/R4) is supplied to the centre terminal of the first voltage divider (R1/R2) via a first diode (D1), a voltage proportional to the voltage at the centre terminal of the third voltage divider (R5/R6) is further supplied to the centre terminal of the first voltage divider (R1/R2) via a second diode (D2), and the voltage at the centre terminal of the first voltage divider (R1/R2) is supplied to the power supply (2) as the reference voltage ($U_{ref}$).

2. The circuit arrangement (1) according to claim 1, wherein the centre terminal of the first voltage divider is connected to the centre terminal of the second voltage divider (R3/R4) via a first diode (D1) and the centre terminal of the first voltage divider (R1/R2) is further connected to the centre terminal of the third voltage divider (R5/R6) via a second diode (D2).

3. The circuit arrangement (1) according to claim 1, wherein the voltage at the centre terminal of the second voltage divider (R3/R4) and/or the third voltage divider (R5/R6) is supplied to the centre terminal of the first voltage divider (R1/R2) via an amplifier stage (T1, R7, R8; T2, R9, R10).

4. The circuit arrangement (1) according to claim 3, wherein the amplifier stage comprises a transistor (T1, T2) the base of which is connected to the centre terminal of the second voltage divider (R3/R4) and/or to the centre terminal of the third voltage divider (R5/R6), wherein the collector connected to a collector resistor (R8, R10) is connected to the centre terminal of the first voltage divider (R1/R2) via the first and/or second diode (D1, D2).

5. The circuit arrangement (1) according to claim 1, wherein the power supply voltage ($U_V$) of the circuit arrangement (1) is also the power supply voltage of the power supply (2).

6. The circuit arrangement (1) according to claim 1, wherein the input voltage ($U_B$) is supplied to the power supply (2) via an interference suppression filter (3).

7. The circuit arrangement (1) according to claim 1, wherein the power supply (2) comprises a controlled current source (4) to which the reference voltage ($U_{ref}$) is supplied and which supplies the feed current ($I_S$) controlled by said reference voltage.

* * * * *